US011504300B2

(12) United States Patent
Guo et al.

(10) Patent No.: US 11,504,300 B2
(45) Date of Patent: Nov. 22, 2022

(54) PILL BOX

(71) Applicant: ZHUHAI QUIN TECHNOLOGY CO. LTD., Zhuhai (CN)

(72) Inventors: Jinpeng Guo, Zhuhai (CN); Wei Du, Zhuhai (CN)

(73) Assignee: ZHUHAI QUIN TECHNOLOGY CO., LTD., Zhuhai (CN)

( * ) Notice: Subject to any disclaimer, the term of this patent is extended or adjusted under 35 U.S.C. 154(b) by 240 days.

(21) Appl. No.: 16/878,644

(22) Filed: May 20, 2020

(65) Prior Publication Data

US 2021/0283014 A1 Sep. 16, 2021

(30) Foreign Application Priority Data

Mar. 10, 2020 (CN) ..... 202020286215.5

(51) Int. Cl.
*A61J 1/03* (2006.01)
*A61J 7/00* (2006.01)

(52) U.S. Cl.
CPC ..... *A61J 1/03* (2013.01); *A61J 7/0084* (2013.01); *A61J 2200/30* (2013.01)

(58) Field of Classification Search
CPC ..... B65D 47/0871
See application file for complete search history.

(56) References Cited

U.S. PATENT DOCUMENTS 7,854,326 B1 * 12/2010 Beckett ..... A61J 7/0084 206/534
10,420,703 B1 * 9/2019 Lee ..... A61J 7/0084
2007/0278227 A1 * 12/2007 Damaghi ..... B65D 43/164 220/254.5

* cited by examiner

*Primary Examiner* — Mollie Impink

(57) ABSTRACT

A pill box includes a box body. The box body includes an accommodating chamber defining an opening and receiving pills. A box closing the accommodating chamber is arranged on the accommodating chamber. A connecting end of the box cover is hinged to a rear end of the box body. An elastic piece and a limiting groove are disposed on the rear end of the box body. A clamping seat is arranged on the connecting end of the box cover. A bending portion is arranged on one end of the elastic piece. A fixing portion is arranged on another end of the elastic piece. The bending portion passes through the clamping seat and is exposed. When the box cover is buckled with the box body, the bending portion is deformed by being squeezed and tightly engages with the box cover, and the fixing portion extends downward into the limiting groove.

7 Claims, 8 Drawing Sheets

PILL BOX

CROSS-REFERENCE TO RELATED APPLICATION

The present application claims foreign priority to Chinese Patent Application No. CN202020286215.5, titled "PILL BOX WITH BUCKLED ELASTIC PIECE," filed on Mar. 10, 2020 in the State Intellectual Property Office of China, and the entire contents of which is hereby incorporated by reference.

TECHNICAL FIELD

The present disclosure relates to a field of medical equipment, in particular, to a pill box with a buckled elastic piece.

BACKGROUND

A pill box is configured to store pills and prevent them from being contaminated by the outside. Generally, an upper cover of the conventional pill box on the market is integrally connected with a main body of the pill box. And when the upper cover is in a closed position to close compartments of the pill box, the upper cover is deformed and bent. When a locking device of the pill box is unlocked, the upper cover is automatically opened by force generated by deformation of the upper cover.

Therefore, the upper cover of the conventional pill box cannot be fully opened, and an opening angle of the upper cover with respect to the main body is insufficient, and it is inconvenient to take pills out from the compartments. In addition, since the pill box is closed most of the time and the upper cover is deformed and bent at the closed position for a long time, the upper cover is easily damaged.

SUMMARY

A main purpose of the present disclosure is to provide a pill box with a buckled elastic piece, which is simple in structure, reasonable in design, convenient in use, convenient in opening a cover, and has a long service life.

In order to achieve the above-mentioned main purpose, the present disclosure provides a pill box with a buckled elastic piece. The pill box comprises a pill box body. The pill box body comprises a box body, where the box body comprises an accommodating chamber configured to receive pills and a top end of the accommodating chamber defining an opening. And a box cover configured to close the accommodating chamber is movably arranged on the accommodating chamber. A connecting end of the box cover is hinged to a rear end of the box body. An elastic piece and a limiting groove are disposed on the rear end of the box body. And a clamping seat is arranged on one side of the connecting end of the box cover. The clamping seat is configured to clamp and fix the elastic piece. A bending portion is arranged on one end of the elastic piece. And a fixing portion is arranged on another end of the elastic piece. The bending portion of the elastic piece passes through the clamping seat and is exposed. When the box cover is completely buckled with the box body, the bending portion of the elastic piece is squeezed by force and elastically deforms and tightly engages with an abutment surface of the box cover, and the fixing portion of the elastic piece extends downward into the limiting groove.

Furthermore, an elastic buckle is disposed on a front end of the box body. And an engaging hole is arranged on an edge of the box cover opposite to the front end of the box body. The box cover is buckled with the box body through the engaging hole and the elastic buckle.

Furthermore, a side of the front end of the box body close to the elastic buckle is protrudingly provided with a pressing portion cooperating with the elastic buckle. When the box cover is completely buckled with the box body, by pressing the pressing portion, the bending portion of the elastic piece is restored to an original shape and the box cover connected with the box body is opened and moves from inside of the box body to outside of the box body.

Furthermore, a predetermined number of baffles are arranged in the accommodating chamber. The baffles divide the accommodating chamber of the box body into one or multiple pill storage compartments.

Furthermore, an outer surface of the box cover defining a transparent window configured to observe an interior of the accommodating chamber.

In the present disclosure, when the pill box is in a sealed state, the box body accommodating the pills is completely closed by the box cover. When taking out the pills, the pressing portion of the front end of the box body is pressed to disengage the elastic buckle from the engaging hole of the box cover. At this time, the bending portion of the elastic piece restores to the original shape and ejects the box cover at a certain angle. After the pills are taken out from the pill box, the box cover is pressed down so that the elastic buckle is buckled with the engaging hole of the box cover. When the box cover is completely closed, the bending portion of the elastic piece is squeezed by force and undergoes elastic deformation, and the bending portion closely cooperates with the abutment surface of the box cover to make the box cover tightly buckled with the box body In addition, the box cover is provided with a transparent window or the box cover is transparent, such that it is convenient for users to replenish or take out pills and the users are able to look into the accommodating chamber through the box cover without opening the box cover.

Therefore, the present disclosure has a simple structure, which is convenient to operate and easy for assembly. The pill box appropriately increases jumping force, reduces pressing force, thereby prolonging the service life of the pill box, and also increasing a speed of opening the pill box, which solves the problems that the conventional box cover in the prior art is inconvenient for opening or taking out the pills. Moreover, the users are able to quickly and easily open the box cover completely and the pill box is able to stay in a same state (open state or closed state) for a long time

DETAILED DESCRIPTION

In order to make the purpose, technical solutions and advantages of the present disclosure more clear, the present disclosure will be described in further detail below with reference to the accompanying drawings and embodiments. It should be understood that the specific embodiments described below are only used to explain the present disclosure, and are not intended to limit the present disclosure.

Figure 1:
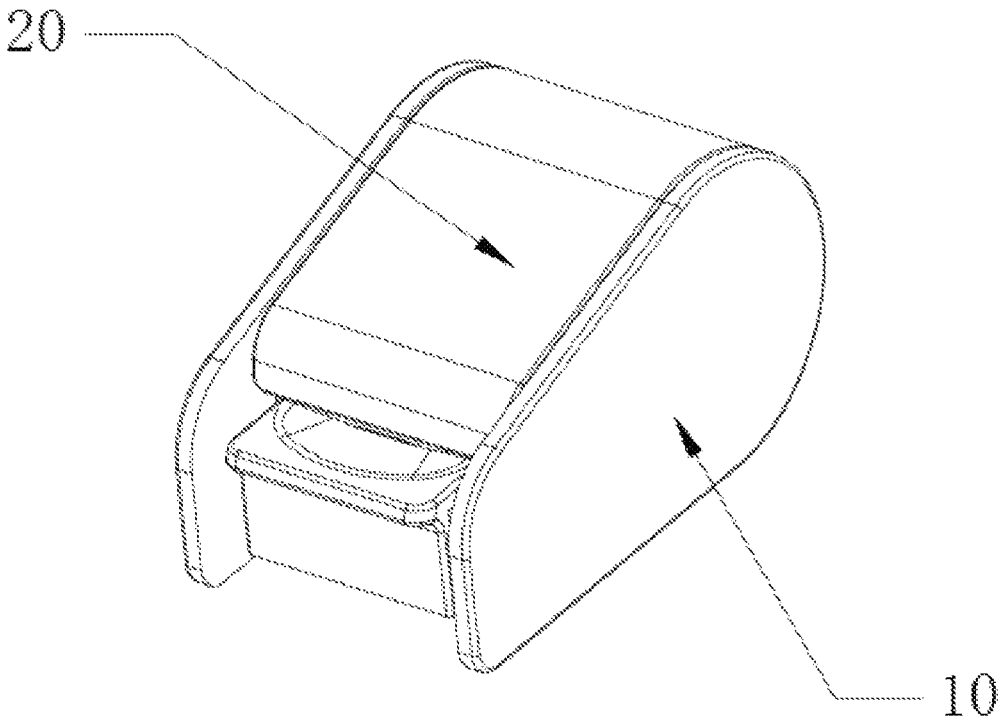
FIG. 1 is a schematic diagram showing a structure of a pill box according to one embodiment of the present disclosure.
Figure 2:
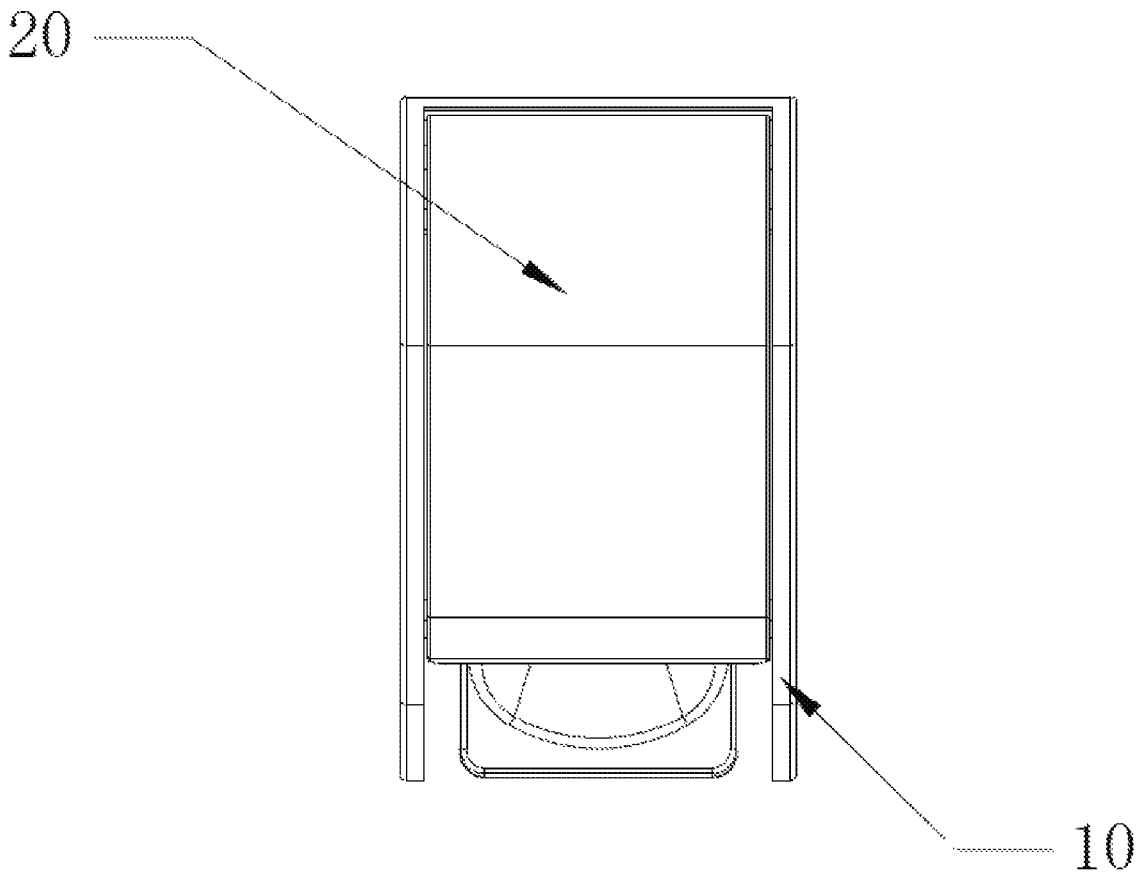
FIG. 2 is a top plan view of the pill box according to one embodiment of the present disclosure.
Figure 3:
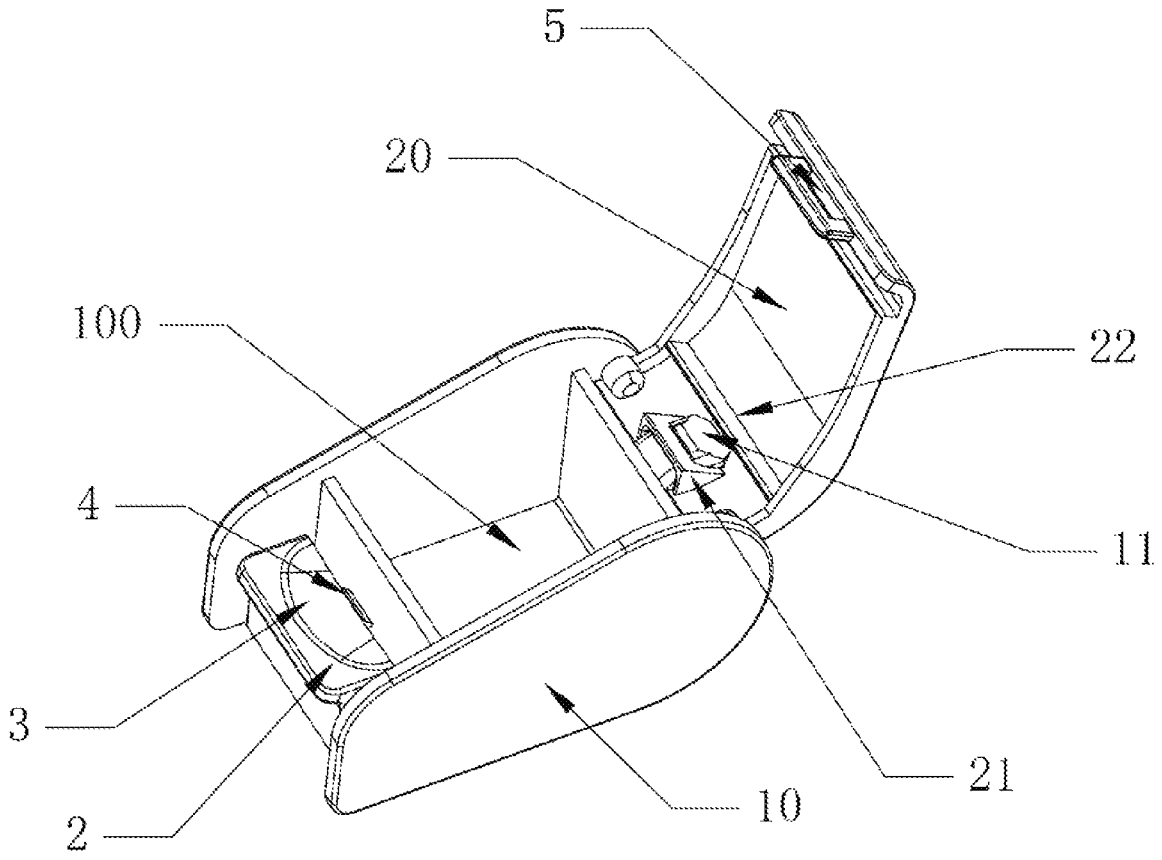
FIG. 3 is a schematic diagram showing the structure of the pill box according to one embodiment of the present disclosure where a box cover is opened.
Figure 4:
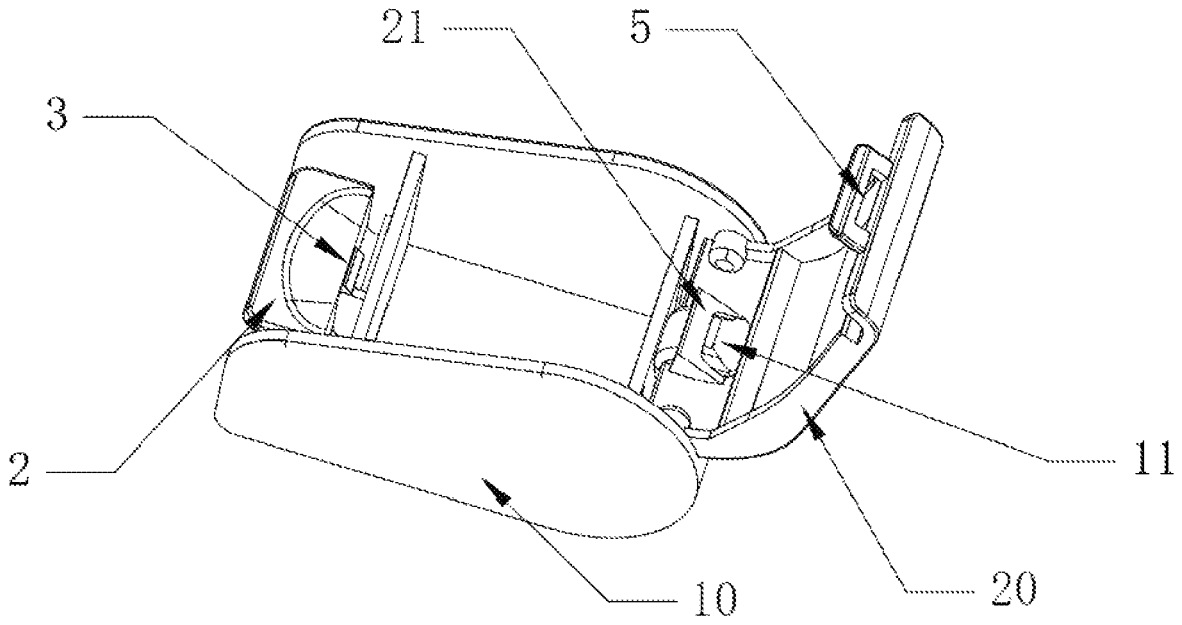
FIG. 4 is another schematic diagram showing the structure of the pill box according to one embodiment of the present disclosure where the box cover is opened.
Figure 5:
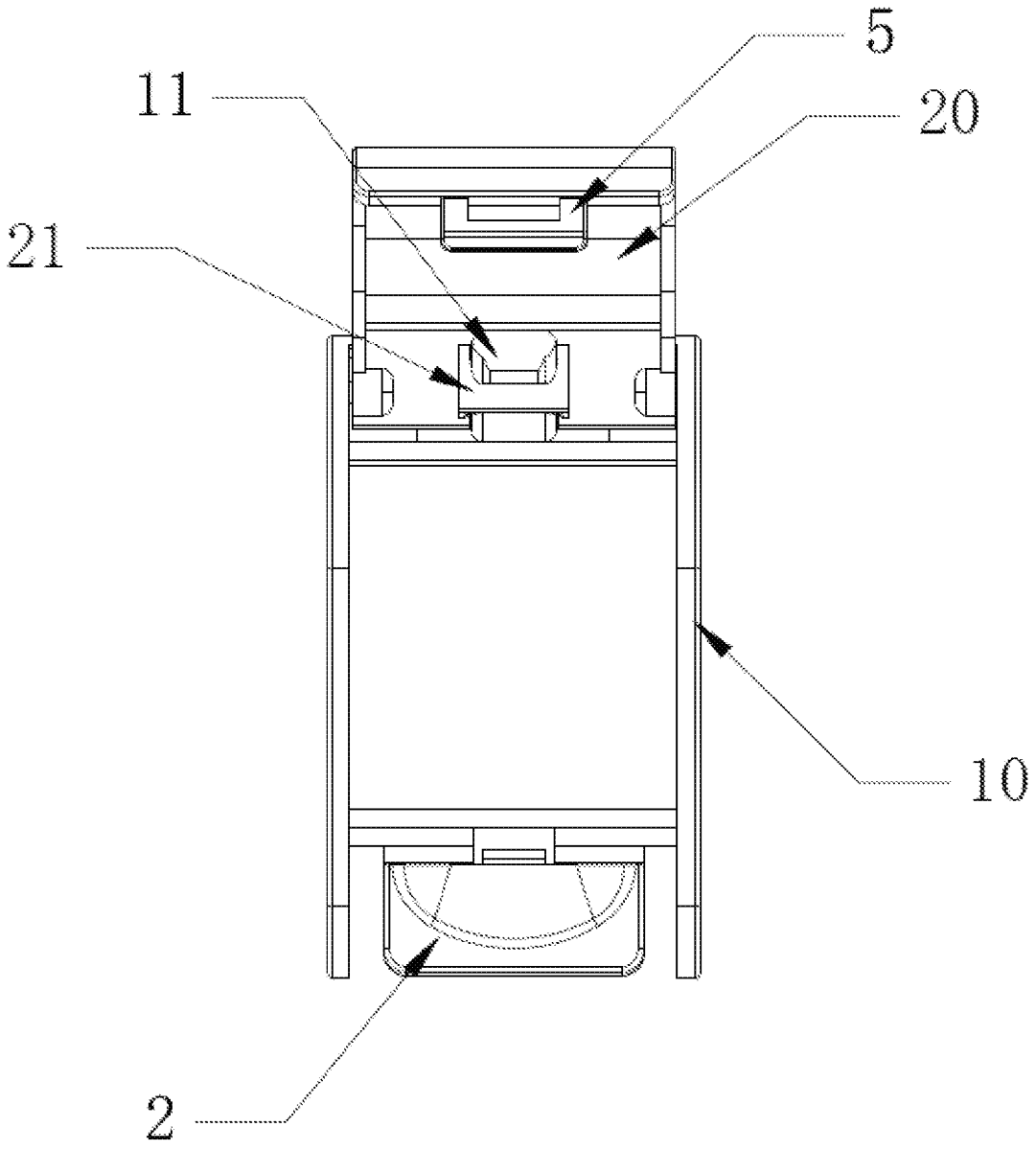
FIG. 5 is a top plan view showing the structure of the pill box according to one embodiment of the present disclosure where the box cover is opened.
Figure 6:
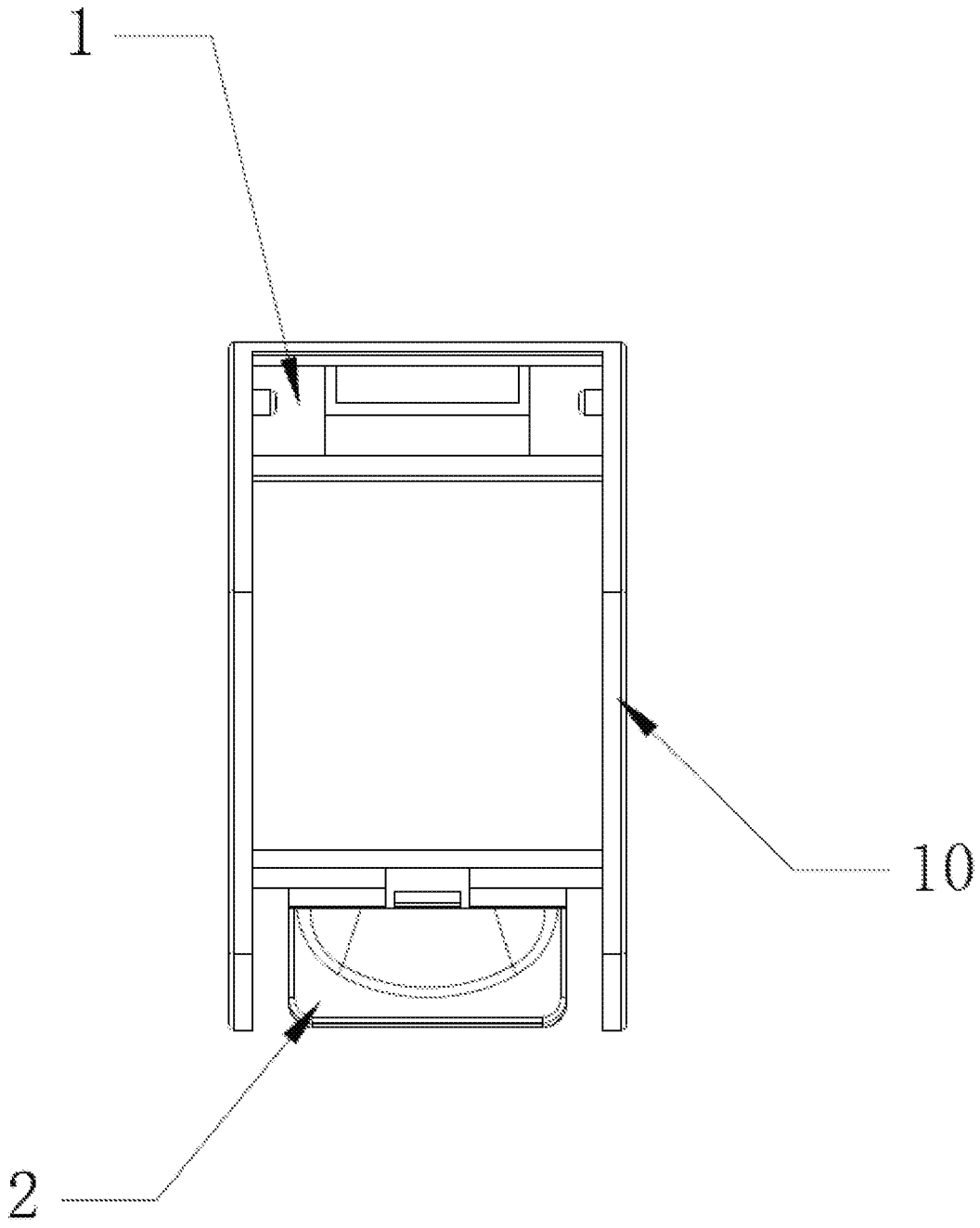
FIG. 6 is a schematic diagram showing the structure of the pill box according to one embodiment of the present disclosure where the box cover is removed.
Figure 7:
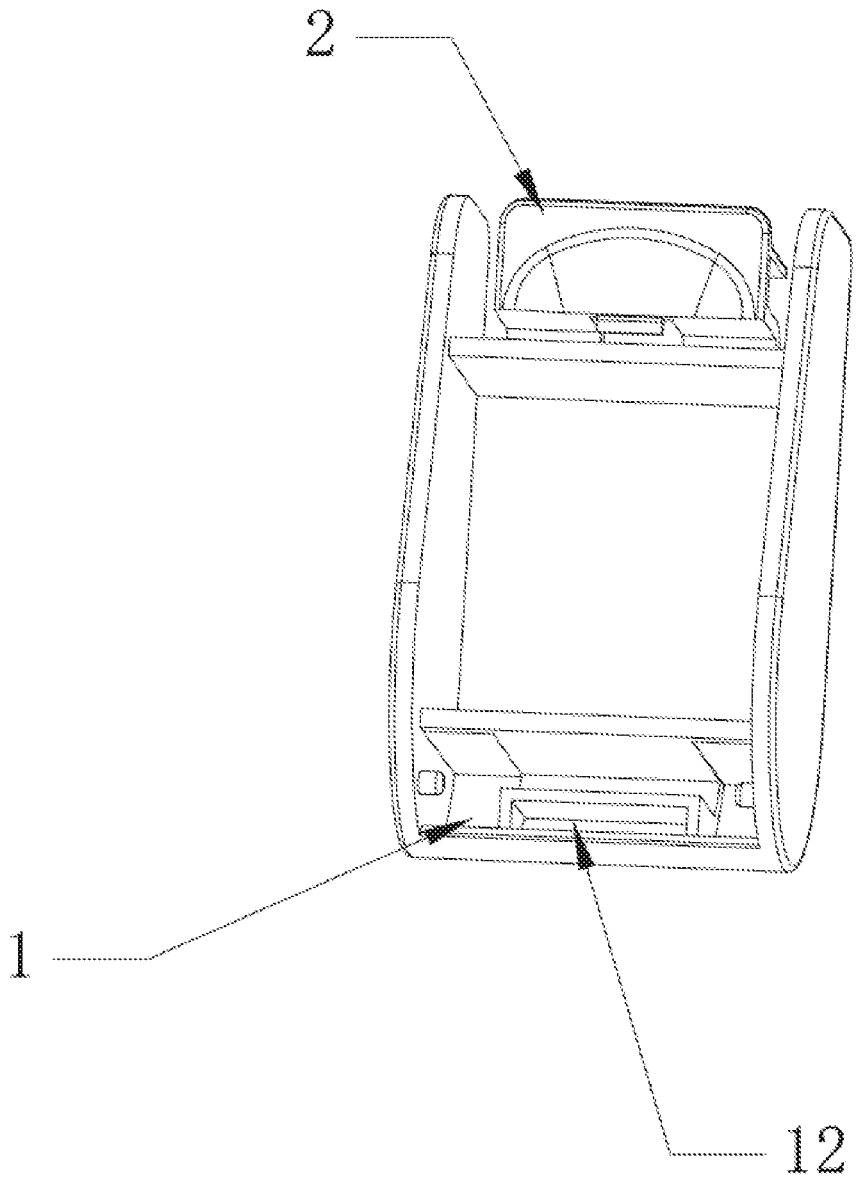
FIG. 7 is a top plan view showing the structure of the pill box according to one embodiment of the present disclosure where the box cover is removed.
Figure 8:
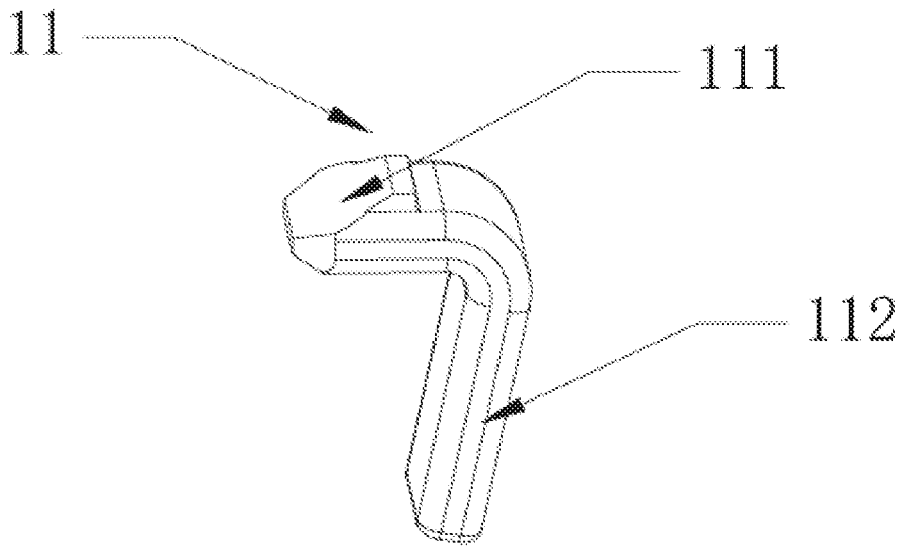
FIG. 8 is a top plan view showing a structure of an elastic piece of the pill box according to one embodiment of the present disclosure.

As shown in FIGS. 1-8, the present disclosure provides a pill box with a buckled elastic piece. The pill box comprises a pill box body. The pill box body comprises a box body 10, where the box body 10 comprises an accommodating chamber 100 configured to receive pills and a top end of the accommodating chamber 100 defining an opening. And a box cover 20 configured to close the accommodating chamber 100 is movably arranged on the accommodating chamber 100. A connecting end of the box cover 20 is hinged to a rear end 1 of the box body 10. An elastic piece 11 and a limiting groove 12 are disposed on the rear end 1 of the box body 10. And a clamping seat 21 is arranged on one side of the connecting end of the box cover 20. The clamping seat 21 is configured to clamp and fix the elastic piece 11. A shape of an outer side of the box cover 20 matches a shape of an inner wall of the box body 10. When the box cover 20 is closed, the outer side of the box cover 20 fits exactly on an upper end of the inner wall of the box body 10.

In one embodiment, bending portion 111 is arranged on one end of the elastic piece 11. A fixing portion 112 is arranged on another end of the elastic piece 11. The bending portion 111 of the elastic piece 11 passes through the clamping seat 21 and is exposed. When the box cover 20 is completely buckled with the box body 10, the bending portion 111 of the elastic piece 21 is squeezed by force and elastically deforms and tightly engages with an abutment surface of the box cover 20, and the fixing portion 112 of the elastic piece 11 extends downward into the limiting groove 12.

In one embodiment, an elastic buckle 4 is disposed on a front end 2 of the box body 10. And an engaging hole 5 is arranged on an edge of the box cover 20 opposite to the front end of the box body 10. The box cover 20 is buckled with the box body 10 through the engaging hole 5 and the elastic buckle 4.

Specifically, a side of the front end 2 of the box body 10 close to the elastic buckle 4 is protrudingly provided with a pressing portion 3 cooperating with the elastic buckle 4. When the box cover 20 is completely buckled with the box body 10, by pressing the pressing portion 3, the bending portion 111 of the elastic piece 11 is restored to an original shape and the box cover 20 connected with the box body 10 is opened and moves from inside of the box body 10 to outside of the box body 10. It can be seen that when a front end of the box cover 20 is separated from the box body 10, the elastic piece 11 quickly returns to its original shape, so that the box cover 20 is automatically and completely opened.

In one embodiment, a predetermined number of baffles are arranged in the accommodating chamber 100. The baffles divide the accommodating chamber 100 of the box body 10 into one or multiple pill storage compartments. In one embodiment, the number of the pill storage compartments is seven, and the required amount of pills in a week are divided in to seven parts and are accommodated in the seven pill storage compartments respectively. Therefore a patient will not miss or eat by mistake while taking the pills, which is convenient for the patient and nursing staff, and convenient for the patient population of different conditions, and the pill box is reasonable in structure.

In one embodiment, an outer surface of the box cover 20 defining a transparent window configured to observe an interior of the accommodating chamber, 100, so that users are able to replenish and take out the pills conveniently.

In one embodiment, the box cover 20 is transparent, so that users are able to observe an interior of the accommodating chamber 100 and thereby replenishing and taking out the pills conveniently.

In the present disclosure, when the pill box is in a sealed state, the box body 10 accommodating the pills is completely closed by the box cover 20. When taking out the pills, the pressing portion 3 of the front end 2 of the box body 10 is pressed to disengage the elastic buckle 4 from the engaging hole 5 of the box cover 10. At this time, the bending portion 111 of the elastic piece 11 restores its shape and position and ejects the box cover 20 at a certain angle. After the pills are taken out from the pill box, the box cover 20 is pressed down so that the elastic buckle 4 is snapped into the engaging hole 5 of the box cover 20. When the box cover 20 is completely closed, the bending portion 111 of the elastic piece 11 is squeezed by force and undergoes elastic deformation, and the bending portion 111 closely cooperates with the abutment surface of the box cover 20 to make the box cover 20 tightly buckled with the box body 10

In addition, the box cover 20 is provided with a transparent window or the box cover 20 is transparent, such that it is convenient for users to replenish or take out pills and the users are able to look into the accommodating chamber through the box cover without opening the box cover.

Therefore, the present disclosure has a simple structure, which is convenient to operate and easy for assembly. The pill box appropriately increases jumping force, reduces pressing force, thereby prolonging the service life of the pill box, and also increasing a speed of opening the pill box, which solves the problems that the conventional box cover in the prior art is inconvenient for opening or taking out the pills. Moreover, the users are able to quickly and easily open the box cover completely and the pill box is able to stay in a same state (open state or closed state) for a long time It should be understood that the above embodiments are only some optional embodiments of the present disclosure, but the design concept of the present disclosure is not limited thereto, any non-substantial modifications made to the present disclosure by this concept also within the scope of the present disclosure.

What is claimed is:

1. A pill box comprising:

a pill box body, wherein the pill box body comprises a box body; the box body comprises an accommodating chamber configured to receive pills, and wherein a top end of the accommodating chamber defines an opening; and a box cover configured to close the accommodating chamber, movably arranged on the accommodating chamber; wherein a connecting end of the box cover is hinged to a rear end of the box body, an elastic piece and a limiting groove are disposed on the rear end of the box body, and a clamping seat is fixedly arranged on an inner side of the connecting end of the box cover, wherein the clamping seat is configured to clamp and fix the elastic piece;

wherein a bending portion is arranged on one end of the elastic piece; a fixing portion is arranged on another end of the elastic piece; the bending portion of the elastic piece passes through the clamping seat and is exposed; when the box cover is completely closed on the box body, the bending portion of the elastic piece is squeezed by force and elastically deforms, and tightly engages with an abutment surface of the box cover, and the fixing portion of the elastic piece extends downward into the limiting groove, wherein when the box cover is opened, the bending portion of the elastic piece restores to an undeformed shape while driving the box cover to rotate from the closed position to a maximum open position, and wherein when the box cover is opened to the maximum opening position, the bending portion is at substantially a right angle with respect to the fixing portion, wherein the bending portion faces toward the box cover.

2. The pill box according to claim 1, wherein an elastic buckle is disposed on a front end of the box body; and an engaging hole is arranged on an edge of the box cover corresponding to the front end of the box body; the box cover is buckled with the box body through the engaging hole and the elastic buckle.

3. The pill box according to claim 2, wherein a side of the front end of the box body close to the elastic buckle is protrudingly provided with a pressing portion cooperating with the elastic buckle; when the box cover is completely buckled with the box body, by pressing the pressing portion, the bending portion of the elastic piece is restored to an original shape and the box cover connected with the box body is opened and moves from inside of the box body to outside of the box body.

4. The pill box according to claim 2, wherein when the box cover is buckled with the box body, the elastic buckle is snapped into the engaging hole.

5. The pill box according to claim 1, wherein a predetermined number of baffles are arranged in the accommodating chamber, and the baffles divide the accommodating chamber of the box body into multiple pill storage compartments.

6. The pill box according to claim 1, wherein an outer surface of the box cover defining a transparent window configured to observe an interior of the accommodating chamber.

7. The pill box according to claim 1, wherein the box cover comprises two cover sidewalls arranged side by side in parallel and a cover plate connected between the two cover sidewalls, and the box body comprises two body sidewalls arranged side by side in parallel, wherein when the box cover is closed on the box body by engaging an engaging hole with an elastic buckle, the upper edges of the two cover sidewalls and an upper surface of the box cover are flush with upper edges of the two body sidewalls.

* * * * *